US006272426B1

(12) United States Patent
Tascillo

(10) Patent No.: US 6,272,426 B1
(45) Date of Patent: Aug. 7, 2001

(54) PREDICTING CYLINDER PRESSURE FOR ON-VEHICLE CONTROL

(75) Inventor: Anya Lynn Tascillo, Belleville, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/449,141

(22) Filed: Nov. 24, 1999

(51) Int. Cl.[7] ..... F02D 41/14; F02P 5/153

(52) U.S. Cl. ..... 701/106; 701/115; 123/406.42; 123/435

(58) Field of Search ..... 701/102, 106, 701/115; 123/406.22, 406.27, 406.41, 406.42, 406.43, 435; 73/115

(56) References Cited

U.S. PATENT DOCUMENTS 5,076,098 12/1991 Miwa .

5,093,792 3/1992 Taki et al. .

*Primary Examiner*—Andrew M. Dolinar
(74) *Attorney, Agent, or Firm*—Jerome R. Drouillard

(57) ABSTRACT

An apparatus for predicting cylinder pressure for on-vehicle control of an internal combustion engine includes a piston sensor, a cylinder pressure sensor, and a controller. The piston sensor is coupled to a piston located in the engine. The piston sensor detects the piston position and generates a piston position signal. The cylinder pressure sensor is coupled to a cylinder located in the engine. The cylinder pressure sensor detects the cylinder pressure and generates a cylinder pressure signal. The controller receives both the piston position signal and the cylinder pressure signal. A neural network, located in the controller, uses this data to predict an undesirable cylinder pressure during a future combustion event. The controller then modifies the future combustion event in response to the predicted undesirable cylinder pressure.

12 Claims, 2 Drawing Sheets

PREDICTING CYLINDER PRESSURE FOR ON-VEHICLE CONTROL

TECHNICAL FIELD

The present invention relates generally to engine controls and, more particularly, to predicting cylinder pressure for on-vehicle control.

BACKGROUND ART

The existence of cyclic variability in the quality of combustion in spark-ignited, internal combustion engine has long been recognized. Such variations may be particularly severe for lean air-fuel mixtures, i.e., when the ratio of air to fuel is greater than that implied by chemical stoichiometry. The analysis of these variations is made difficult by the existence of several possible mechanisms that could act separately or in concert. One problem is the variations in the delivery of air and fuel into the cylinder. The effect of variations either in mass of fuel or its distribution tend to be exacerbated under lean conditions, when the total mass of fuel is relatively smaller. It is recognized that the fluid dynamic effects during engine intake and exhaust strokes are dominant contributors in cyclic variations. The importance of the residual gas, both content and amount, has also been recognized and is generally regarded as the cause of the frequently observed alternating pattern of high and low work output cycles, although other mechanisms have been proposed. Investigators have considered cyclic variations from the standpoint of understanding the mechanism well enough to effect a reduction in the variation by imposing control. They found that significant correlation exists between consecutive firings of a particular cylinder, and that various relevant measurable quantities, such as indicated mean effective pressure, are subject to reasonable prediction one cycle in advance. Various means of imposing control, such as through changes of spark timing and fuel delivery have been considered.

Because the combustion process depends on several state variables and is nonlinear, it is a candidate for exhibiting the complex behavior called deterministic chaos, or just chaos for short. If chaotic behavior takes place in a system with many important state variables (e.g., more than ten), it is termed high-dimensional chaos. While high dimensional chaos is in principle deterministic, it is usually so complex that as a practical matter (at least with current understanding), it can only be treated with methods applicable to stochastic (random) systems. Hence to be of present practical importance, e.g., for better fundamental understanding or real-time control of a physical system, it is necessary for the identified chaotic behavior to be low-dimensional, (e.g., have a number of important state variables that is less than ten).

Prior art has established models that generate data scatter that looks very much like that of the real data, but no one has been able to predict when the next outlier will occur. Thus, there exists a need to improve the accuracy of prediction of undesirable combustion events during lean (high air/fuel ratio) engine operation.

SUMMARY OF THE INVENTION

It is, therefore, an object of the invention to provide an improved and reliable means for predicting undesirable cylinder pressures of future combustion events. Another object of the invention is to improve the operation of lean burn internal combustion engines. Generally, the present invention improves air-fuel control during intake control device transitions by compensating for fuel transport dynamics and the actual fuel injected into each cylinder.

In one aspect of the invention, an apparatus for predicting cylinder pressure for on-vehicle control of an internal combustion engine includes a piston sensor, a cylinder pressure sensor, and a controller. The piston sensor is coupled to a piston located in the engine. The piston sensor detects the piston position and generates a piston position signal. The cylinder pressure sensor is coupled to a cylinder located in the engine. The cylinder pressure sensor detects the cylinder pressure and generates a cylinder pressure signal. The controller receives both the piston position signal and the cylinder pressure signal. A neural network, located in the controller, uses this data to predict an undesirable cylinder pressure during a future combustion event. The controller then modifies the future combustion event in response to the predicted undesirable cylinder pressure.

The present invention achieves an improved and reliable means for predicting undesirable cylinder pressures of future combustion events. Also, the present invention is advantageous in that it allows engine operation with very lean air to fuel ratios, being extremely flexible.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODE(S) FOR CARRYING OUT THE INVENTION

Figure 1:
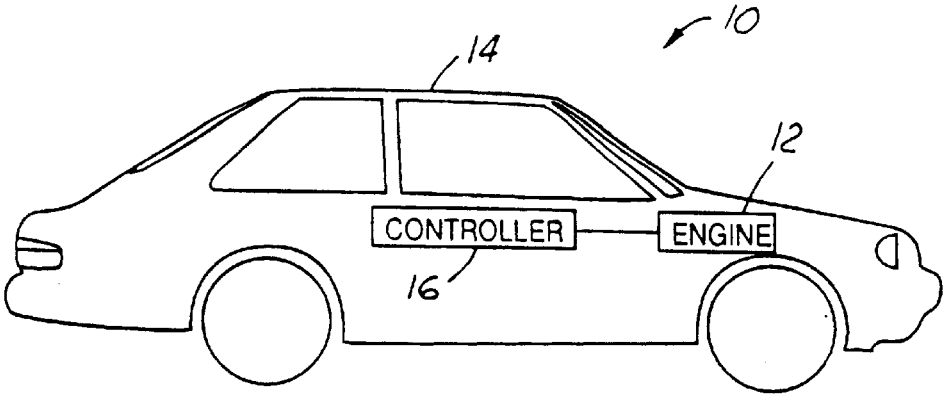
FIG. 1 is a block diagram of an automotive system for predicting cylinder pressure for on-vehicle control in accordance with one embodiment of the present invention.

Referring to FIG. 1, a block diagram of an automotive system 10 for predicting cylinder pressure for on-vehicle control in accordance with one embodiment of the present invention is illustrated. The automotive system 10 is comprised of an internal combustion engine 12 located in a vehicle 14. Vehicle 14 also includes an apparatus for predicting cylinder pressure for on-vehicle control 16 that is coupled to internal combustion engine 12.

Figure 2:
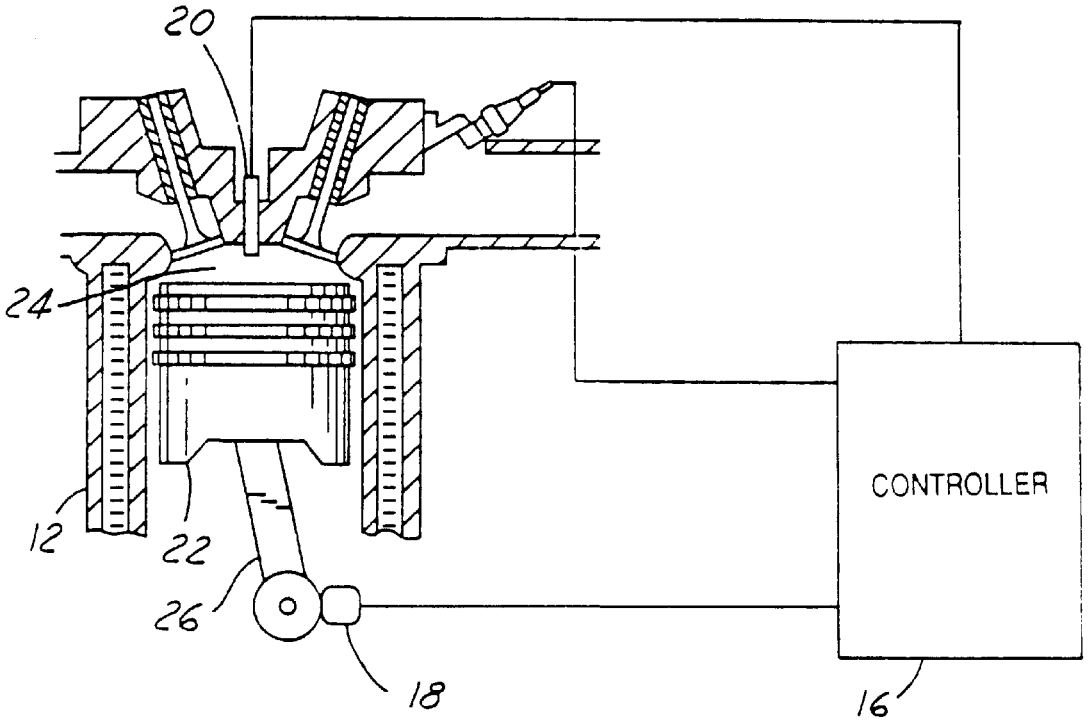
FIG. 2 is a block diagram of an apparatus for predicting cylinder pressure for on-vehicle control in accordance with one embodiment of the present invention.

Referring now to FIG. 2, a block diagram of an apparatus for predicting cylinder pressure for on-vehicle control 16 in accordance with one embodiment of the present invention is illustrated. Apparatus 16 includes a piston sensor 18, a cylinder pressure sensor 20, and a controller 22.

Piston sensor 18 is located in engine 12 and detects the position of piston 24. Piston sensor 18 measures the location of the piston and generates a piston position signal whenever a combustion event occurs. Piston sensor 18 may be any sensor capable of measuring piston position during a combustion event. In the present example, piston sensor 18 is a crankshaft sensor coupled to a crankshaft located in engine 12 that generates a crankshaft angle signal. Piston position is then interpolated from the crankshaft angle. Other piston sensors can include, but are not limited to, a cam shaft position sensor, a timing gear position sensor, a flywheel position sensor, or any other sensor from which piston position may be derived.

Cylinder pressure sensor 20 is located in engine 12 and detects the pressure in cylinder 26. Cylinder pressure sensor 20 measures the pressure in the cylinder and generates a cylinder pressure signal whenever a combustion event occurs. Cylinder pressure sensor 18 may be any sensor capable of measuring piston position during a combustion event. In the present example, cylinder pressure sensor 18 is an analog pressure sensor mounted in a combustion chamber of engine 12. Other means for determining cylinder pressure during a combustion event may include, a strain/stress gauge mounted on rod 28 or rod journal 30, or any other sensor from which cylinder pressure may be derived.

Controller 22 is located in vehicle 14 and is coupled to piston sensor 18 and cylinder pressure sensor 20. Controller 22 includes a neural network or other trained classifier that uses the piston position signal and/or cylinder pressure signal to predict the cylinder pressure of future combustion events. In the present example, a radial basis function neural network is used, but one skilled in the art would recognize that other neural networks could perform the same function. When controller 22 determines (predicts) that an undesirable pressure is going to occur in a future combustion event, steps may be taken to prevent this undesirable pressure from happening. These steps include, but are not limited to, modifying spark ignition timing or modifying an injected fuel amount to in anticipation of a future undesirable pressure. An undesirable pressure includes misfires, knocks, pre-ignitions, or slow burns.

In operation, as the air/fuel ratio is increased (leaned out) past the lean limit of a combustion process (approximately 24:1), the shape of the cylinder pressure curve starts to become erratic. This results in variable maximum cylinder pressure (called x) as well as variable angular location (piston position) of that maximum cylinder pressure (called y). The least useful combination of x and y are lower values for each (i.e. low maximum cylinder pressure occurring sooner than optimal). However, any low cylinder pressure during a combustion event is not desirable. Specifically, low cylinder pressure during a combustion event means that less potential energy is being converted to work, this results in less engine power, more carbon build up, and additional hydrocarbons present in exhaust emmissions.

Figure 3:
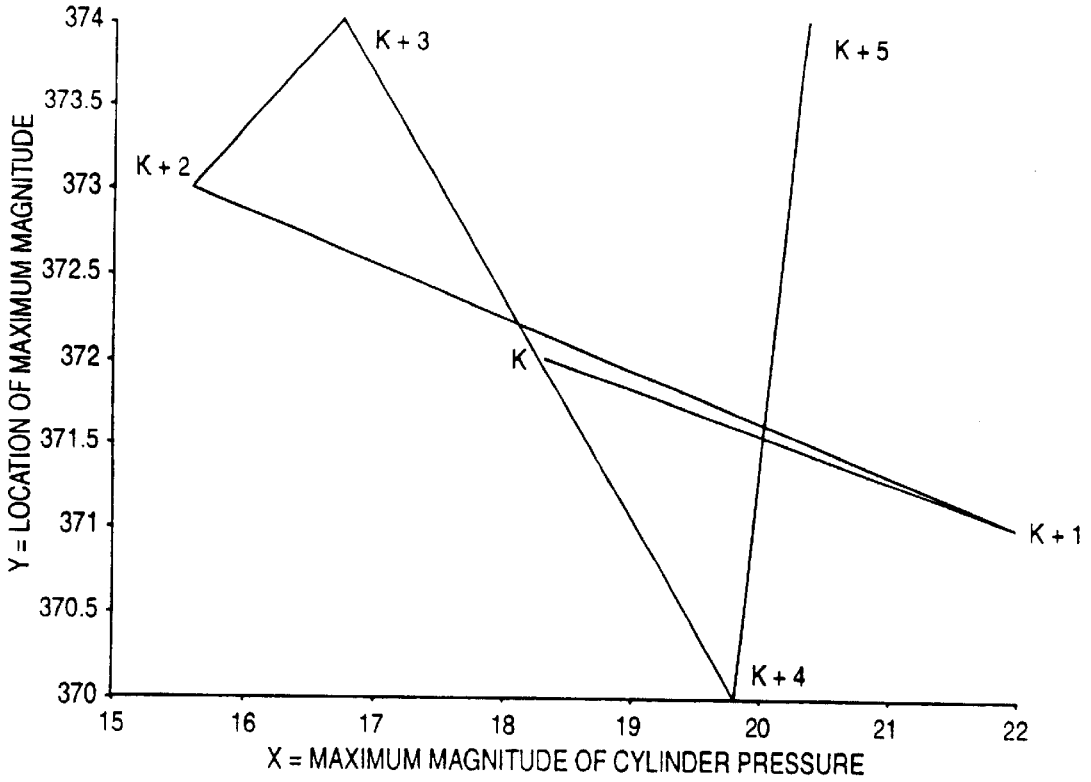
FIG. 3 is a graph representing the trajectories of five prior combustion events leading to a non-outlier in accordance with one embodiment of the present invention.

Referring to FIG. 3, a graph representing the trajectories of five prior combustion events leading to a non-outlier is illustrated. Data sets (x and y) used for modeling and control are mostly deterministic data with a smaller percentage of noise included. The unique challenge of this particular data is that the desired state is one that is uniformly noisy, in the shape of an extended gaussian. When the system begins to exhibit undesirable behavior, the path followed by the variables in time actually becomes more deterministic.

This is best captured by not only training a neural network with prior x and y values, but also the angle formed by the trajectory of their combination. Let x equal the normalized maximum height achieved by a cylinder pressure trace over a combustion event (k). Let y equal the normalized crank angle location of that maximum peak. The slope m(k) of the line between two combustion events k and k+1 is:

$$m(k)=(y(k+1)-y(k))/(x(k+1)-x(k));$$

and the angle is shown as:

$$\text{angle}\ (k)=a\ \tan 2\ (m(k+1)-m(k),\ (1+m(k)*m(k+1)))$$

For predicting undesirable pressure in a future combustion event, controller 22 may use only cylinder pressure (x), only piston position (y), only angle, derivatives or integrals. The most successful combination, however, is five steps of x, y, and angle.

In FIG. 3, a graph representing the trajectories of five prior combustion events leading to a non-outlier in accordance with one embodiment of the present invention is illustrated. Beginning with the combustion event that occurred five cycles ago, k+5, and continuing through the present combustion event k;

| Event | x | y |
|---|---|---|
| k + 5 | 20.4 | 374 |
| k + 4 | 19.8 | 370 |
| k + 3 | 16.7 | 374 |
| k + 2 | 15.5 | 373 |
| k + 1 | 22.0 | 371 |
| k | 18.4 | 372 |

Using the above formulas to calculate slope and angle it can be shown that;

| Event | Slope | Angle |
|---|---|---|
| k + 4 | 6.667 | |
| k + 3 | −1.290 | −43.69 |
| k + 2 | 0.333 | −177.97 |
| k + 1 | −0.303 | 33.92 |
| k | −0.273 | 91.53 |

Note the compact footprint and random changes in direction. This is typical behavior exhibited in non-outlier events. Typical outlier events tend to have paths that stay clockwise, counterclockwise, or in a straight path before leaving the compact footprint of the non-outliers.

For training the neural network of controller 22, a data set is collected from engine 22. Approximately 750 to 1000 x/y data points collected during the operation of engine 12 may be used. In the present example, the data set was selected to avoid any undesirable outliers among the points leading up to the target of interest. In testing it was found that data sets taken after engine 12 was operating for a period of time produced superior results in the neural network. For example, at least 6000 cycles after initial engine operation.

Additionally, during operation the neural network of controller 22 may re-train itself. Controller 22 begins by sensing a plurality of piston positions during a plurality of combustion events to generate a plurality of piston position signals in response to said piston positions. Controller 22 then senses a plurality of cylinder pressures during the same plurality of combustion events to generate a plurality of cylinder pressure signals in response to said cylinder pressures. Controller 22 then generates a plurality of angles formed by the plurality of trajectories of the past cylinder pressures plotted versus the past piston positions in time and collects these past angles, pressures and positions in a data set.

The neural network is then trained upon the data set and controller 22 uses this trained neural network to predict undesirable cylinder pressure for future combustion events.

During operation controller 22 constantly compares the predicted undesirable cylinder pressures to actual cylinder pressures to determine an error rate. If the error rate is unacceptable (i.e. exceeds some predetermined threshold), then controller 22 re-train the neural network. The neural network is re-trained based upon a hybrid data set comprising a new (recently collected) data set and the original data set with a forgetting factor. Controller 22 then implements the re-trained neural network.

Previously models have been established that generate data scatter that looks very much like that of the real data, but no one has been able to predict when the next outlier will occur. The present invention is also extremely flexible, in that it will work over an very wide range of user selectable cylinder pressures and piston positions. This flexibility outliers to be defined by any vibration the customer may perceive, and satisfy customer desired NVH.

From the foregoing, it can be seen that there has been brought to the art a new and improved system for controlling air-fuel ratio during intake control device transitions. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. An apparatus for predicting cylinder pressure for on-vehicle control of an internal combustion engine comprising:

a piston sensor coupled to a piston located in said engine, said piston sensor detecting a piston position and generating a piston position signal during a combustion event;

a cylinder pressure sensor coupled to a cylinder located in said engine, said cylinder pressure sensor detecting a cylinder pressure and generating a cylinder pressure signal during said combustion event; and a controller coupled to said piston sensor and said cylinder pressure sensor, said controller receiving said piston position signal and said cylinder pressure signal, said controller having a trained classifier predicting an undesirable cylinder pressure during a future combustion event based upon a plurality of past piston position signals correlated with a plurality of past cylinder pressure signals, said controller modifying said future combustion event in response to said undesirable cylinder pressure, wherein said controller predicts an undesirable cylinder pressure during a future combustion event based upon an angle formed by a trajectory of cylinder pressure during two combustion events plotted versus piston position during said two combustion events in time.

2. The apparatus for predicting cylinder pressure for on-vehicle control of an internal combustion engine as recited in claim 1, wherein said trained classifier comprises a radial basis function neural network.

3. The apparatus for predicting cylinder pressure for on-vehicle control of an internal combustion engine as recited in claim 1, wherein said controller predicts an undesirable cylinder pressure during a future combustion event based upon a plurality of past angles formed by the trajectories of past cylinder pressures plotted versus past piston positions in time.

4. A method for predicting cylinder pressure for on-vehicle control of an internal combustion engine, comprising the steps of:

sensing a piston position during a combustion event to generate a piston position signal in response to said position;

sensing a cylinder pressure during said combustion event to generate a cylinder pressure signal in response to said cylinder pressure;

receiving said cylinder pressure and said piston position;

predicting an undesirable cylinder pressure during a future combustion event based upon an angle formed by a trajectory of cylinder pressure during two combustion events correlated versus piston position during said two combustion events in time using a trained classifier; and modifying said future combustion event in response to said undesirable cylinder pressure.

5. The method for predicting cylinder pressure for on-vehicle control of an internal combustion engine as recited in claim 4, wherein the step of sensing a piston position comprises sensing a crankshaft angle position during a combustion event to generate a crankshaft angle signal corresponding to piston position.

6. The method for predicting cylinder pressure for on-vehicle control of an internal combustion engine as recited in claim 4, wherein said neural network comprises a radial basis function neural network.

7. The method for predicting cylinder pressure for on-vehicle control of an internal combustion engine as recited in claim 4, wherein the step of modifying said future combustion event in response to said undesirable cylinder pressure comprises modifying a spark ignition timing to correct for said undesirable cylinder pressure.

8. The method for predicting cylinder pressure for on-vehicle control of an internal combustion engine as recited in claim 11, wherein the step of modifying said future combustion event in response to said undesirable cylinder pressure comprises modifying an injected fuel amount to correct for said undesirable cylinder pressure.

9. The method for predicting cylinder pressure for on-vehicle control of an internal combustion engine as recited in claim 4, wherein the step of predicting an undesirable cylinder pressure comprises predicting an undesirable cylinder pressure based a plurality of past angles formed by the trajectories of past cylinder pressures plotted versus past piston positions in time.

10. The method for predicting cylinder pressure for on-vehicle control of an internal combustion engine as recited in claim 4, further comprising the step of training said neural network using a plurality of past angles formed by the trajectories of past cylinder pressures plotted versus past piston positions in time.

11.The method for predicting cylinder pressure for on-vehicle control of an internal combustion engine as recited in claim 10, wherein said data set is taken after an initial engine-operating period.

12. The method for predicting cylinder pressure for on-vehicle control of an internal combustion engine as recited in claim 11, wherein said data set is taken before an undesirable cylinder pressure.

* * * * *